United States Patent [19]

Dolan

[11] Patent Number: 4,470,693

[45] Date of Patent: Sep. 11, 1984

[54] SELF-CLEANING XEROGRAPHIC APPARATUS

[75] Inventor: Donald T. Dolan, Ridgefield, Conn.

[73] Assignee: Pitney Bowes Inc., Stamford, Conn.

[21] Appl. No.: 338,700

[22] Filed: Jan. 11, 1982

[51] Int. Cl.[3] ..... G03G 15/00

[52] U.S. Cl. ..... 355/15; 355/3 DD; 355/3 TR; 355/3 CH; 355/14 D; 355/14 TR; 355/14 CH; 430/35; 358/300

[58] Field of Search ..... 355/3 R, 3 CH, 14 R, 355/14 CH, 15, 3 TR, 14 TR, 14 E, 14 D, 3 DD; 430/125, 35, 48; 358/296, 300

[56] References Cited

U.S. PATENT DOCUMENTS

| | | | |
|---|---|---|---|
| 2,297,691 | 10/1942 | Carlson | 430/31 X |
| 2,890,968 | 6/1959 | Giaimo, Jr. | 355/4 X |
| 3,649,262 | 3/1972 | Cade et al. | 355/15 X |
| 3,661,452 | 5/1972 | Henes et al. | 355/3 R |
| 4,017,170 | 4/1977 | Komori et al. | 355/14 R X |
| 4,122,462 | 10/1978 | Hirayama et al. | 355/3 R X |
| 4,167,324 | 9/1979 | Wu | 355/3 R |
| 4,265,998 | 5/1981 | Barkley | 430/125 |

FOREIGN PATENT DOCUMENTS 2035211 6/1980 United Kingdom .

*Primary Examiner*—A. C. Prescott

*Attorney, Agent, or Firm*—Peter Vrahotes; Albert W. Scribner; William D. Soltow, Jr.

[57] ABSTRACT

Method and apparatus for xerographic printing wherein a magnetic brush unit is used to both apply toner to an image on a photoconductive surface and clean the surface in the same cycle. A reverse imaging process is used in combination with an electronically controlled exposure station. A cleaner or separate cleaning station is not required in the inventive method and apparatus described herein.

12 Claims, 2 Drawing Figures

SELF-CLEANING XEROGRAPHIC APPARATUS

BACKGROUND OF THE INVENTION

In the xerographic process of producing copies, an image is created upon a photoconductive surface by first placing a uniform electrostatic charge on the photoconductive surface and then exposing such charged surface to light so as to create a desired image thereon. In the standard xerographic copying technique, light is reflected from the background or non-printed portion of a document to be reproduced and the text or printed portion of the document will appear on the photoconductive surface as an image of charged areas surrounded by a substantially neutral background. This image is then developed by contacting such image with a toner or development powder charged with a polarity opposite to that of the image charge. This toner is placed into contact with the photoconductive surface at a development station either through a cascading device or a magnetic brush unit. The toner particles on the now developed image are then transferred to a sheet upon which the transferred image is subsequently fused. Unfortunately, the transfer of toner is not completely efficient, resulting in a residual deposit of finely divided toner particles remaining on the photoconductive surface. Before the photoconductive surface can be used in another copy cycle, it is necessary that this residual toner be removed without harmful effect to the photoconductive surface otherwise ghosting will begin to show up on subsequent copies resulting in poor copy quality. Ghosting is the reproducing of post images of prior document reproduction which results from failure to clean the photoconductive surface after transfer takes place.

In the past, different systems have been used for the purpose of cleaning residual toner from a photoconductive surface. Some schemes involved cascading a cleaning powder onto the photoconductive surface following the transfer step so as to carry away the residual toner. The most common cleaning system is a mechanical rotating brush using a material such as fur or felt bristles in combination with a vacuum cleaner collector that would carry away the particles removed by the brush. Another method used a magnetic brush unit to remove residual toner in combination with a cascading development station. Still another system involved the use of a magnetic brush unit which would first develop an image and then the machine would go through a second cycle during which the magnetic brush unit would act as a cleaning station. In all of these prior schemes for removing residual toner from a photoconductive surface a cleaning station was provided that removed the residual toner or a second cycle was necessary to accomplish the cleaning function.

SUMMARY OF THE INVENTION

A method and apparatus has been devised wherein an independent cleaning station is not required nor is a second cycle necessary for the purpose of cleaning toner residue from the photocoductive surface of a xerographic apparatus. This method and apparatus involves placing a charge of a first polarity on the photoconductive surface, discharging selective portions of the photoconductor to create a substantially neutral image of the text to be reproduced, imparting a charge to toner particles of the same polarity but at a lower level than the charge on the photoconductive surface, and contacting the photoconductive surface with the charged particles. It has been found that during a subsequent development step, the residual toner is automatically cleaned from the photoconductive surface by the magnetic brush unit prior to transfer of the subsequent image.

DETAILED DESCRIPTION OF THE PREFERRED EMBODIMENTS

Figure 1:
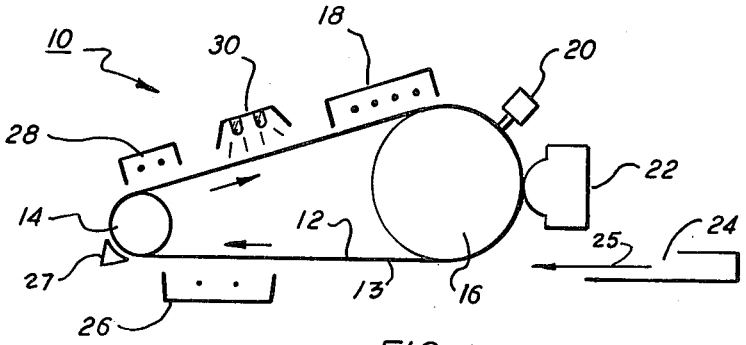
FIG. 1 is a schematic diagram showing an apparatus that utilizes the method of this invention.

Referring to FIG. 1, a xerographic apparatus or printer is diagramatically shown generally at 10 that incorporates the instant invention. The apparatus 10 includes an endless belt 12 that has a photoconductive surface 13 on the outer surface thereof. The belt 12 is trained about a roller 14 and a drum 16, either one of which may be driven for the purpose of rotating the photoconductive belt in a closed path. The photoconductive belt 12 would be of a generally known type comprising a substrate such as mylar with a first layer of thin aluminum and a second photoconductive layer 13 disposed on the outer surface thereof. Such photoconductive surface 13 may be either zinc oxide, cadmium sulfide or an organic substance having photoconductive properties. As seen in FIG. 1, the photoconductive belt 12 would be rotated in a clock-wise direction.

Addressing the photoconductive surface 13 of the belt 12 are a plurality of processing stations including a charge station 18, such as a charge corotron or scorotron, that applies a uniform charge to the photoconductive surface as it passes such station. Downstream from the charge station 18 is an imaging station 20. This imaging station 20 preferably is of the type that directs light upon the photoconductive surface that is representative of the text to be printed or reproduced. Examples of devices that may be used as an imaging station are light emitting diode (LED) arrays and laser systems that are connected to appropriate electronic circuits. A system of the latter type is disclosed in U.S. Pat. No. 4,214,157. Downstream from the imaging station 20 is a development station 22 that is preferably a magnetic brush unit. This magnetic brush unit 22 will be biased with a voltage of the same polarity as the charging station 18 but at a lower level. A feed station 24 is located downstream from the development station 22 to convey a sheet 25 of paper to the photoconductive surface 13. A transfer station 26 is located downstream therefrom so that a sheet 25 will pass between the photoconductive surface 13 with the developed image thereon and the transfer station. The transfer station 26 is charged with a polarity opposite to that of the toner so as to cause the toner to be attracted thereto and be deposited on the sheet 25 to form the image thereon. Downstream from the transfer station 26 is a separating station 27 wherein the sheet with the transferred image thereon is separated from the belt 12 and downstream therefrom is a cleaning corotron 28 and a cleaning lamp 30. The sheet with the image thereon will be conveyed to a fusing station (not shown) to fuse the toner particles thereon and complete the print cycle. Downstream from the cleaning lamp 30 is the charge station 18 wherein the cycle would be repeated.

It will be appreciated that as used in this invention, the xerographic apparatus does not technically produce a copy. This is because the information to be reproduced is not derived directly from a document but is received electronically. For this reason, the reproducing of text performed by the xerographic apparatus 10 of this invention will be defined as "printing" as opposed to "copying".

In operation, the photoconductor belt 12 would be rotated about the roller 14 and drum 16 and become negatively charged uniformly by the charge scorotron 18. The imaging station 20 would selectively discharge areas of the charged photoconductive surface 13 by directing light upon the surface to create a neutral image, the balance of the photoconductive sheet still being negatively charged. This negatively charged area is referred to as the background. It will be appreciated that this is the reverse of standard xerographic process wherein the background is discharged and a charged image remains. The areas that are discharged by the light from the imaging station 20 attract toner particles from the magnetic brush unit 22 as the image created on the photoconductive surface 13 is moved past the development station. More specifically, the toner particles have a potential that is the sum of the magnetic brush unit 22 bias and the triboelectric charge created within the particles. The toner particles are repulsed by the background, or non-image areas, and would tend to gather at the neutral image area. These toner particles would be charged with a negative charge that is of a lower charge level than the charge level on the background of the photoconductive surface and would then be attracted to the neutral image. This development process is reverse from that used in standard xerographic copiers wherein the toner would adhere to the areas that retain the surface charge on the photoconductive surface. It is the use of the reverse process of the normal xerographic process that brings about the self-cleaning feature of this invention.

As an example, during the print cycle, the charge scorotron 18 deposits voltage of a −600 to −800 V on the photoconductive surface 13. Toner particles have a charge of approximately −300 to −500 V imparted thereto and are attracted to the discharged areas since, relatively speaking, the neutral area is positive compared to the negatively charged toner. As indicated previously, the toner particle charge is an accumulation of the triboelectric charge and the bias of the magnetic brush unit 22. As the belt 12 continues to rotate, a sheet 25 of paper is fed from the feed station 24 sychronously with the rotation of the belt so that the sheet would overlap the developed image portion of the photoconductive surface 13. The developed image is transferred to the paper as a result of the transfer corotron 26 creating a positive electric field that causes the toner to be attracted to the paper 24. Untransferred toner adheres to the photoconductive surface 13 and passes under the cleaning corotron 28 and then under the cleaning lamp 30. The corotron 28 charges the toner and photoreceptor negatively and the cleaning lamp 30 discharges the photoreceptive surface but has no effect on the toner charge. The residual toner and uncharged photoreceptor now passes again under the charge station 18 which charges the photoreceptor/toner combination. Thus, the toner particles have been charged negatively twice, once by the cleaning corotron 28 and once by the charging scorotron 18. The photoreceptive surface 13 has been charged, discharged and re-charged.

Figure 2:
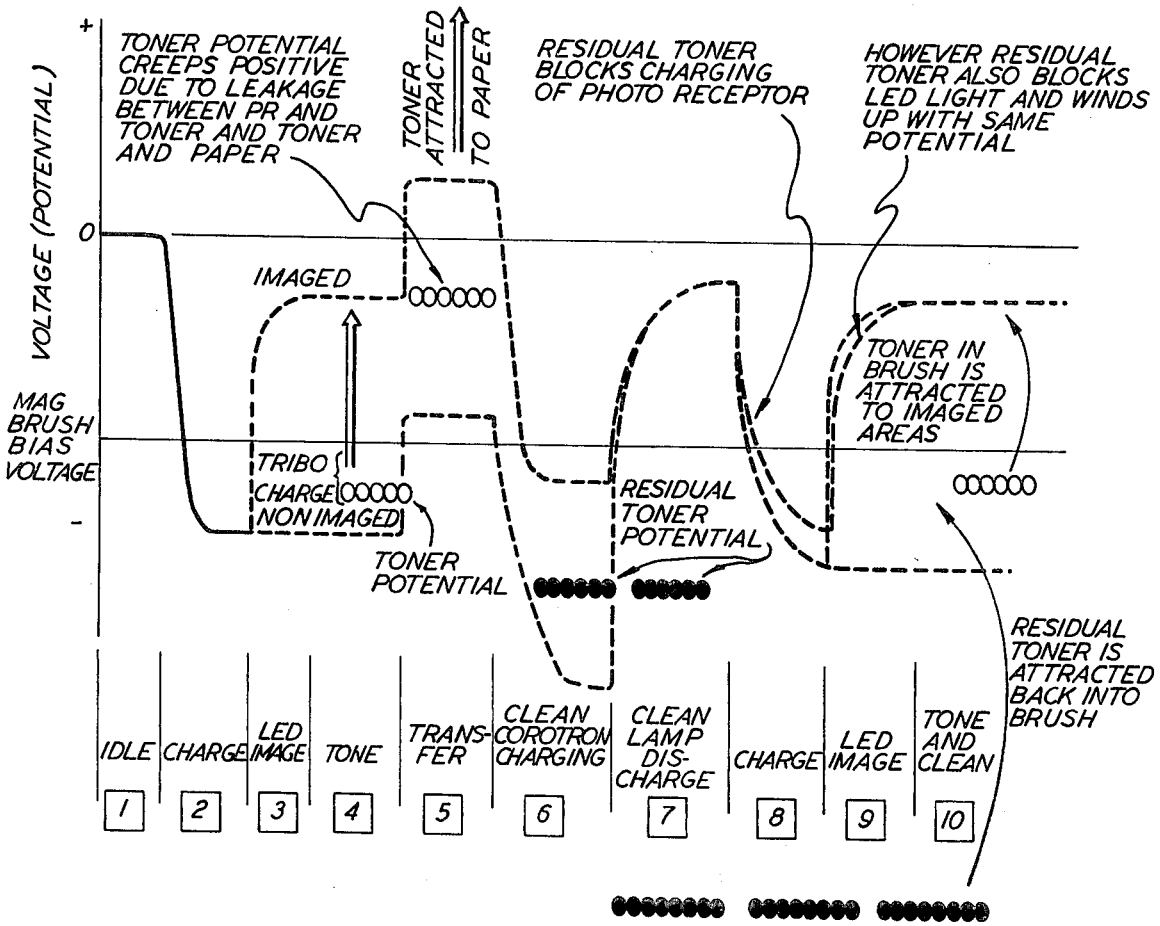
FIG. 2 is a diagram showing the charge of the toner and photoconductor at various stations of the apparatus shown in FIG. 1 along with brief descriptions thereof.

FIG. 2 illustrates why such a self cleaning result can be realized. The cleaning corotron 28 and charging scorotron 18 are both negative in the system. The action of these two charging units 18, 28 and cleaning lamp 30 is to charge the residual unwanted toner to a higher negative potential level, thus creating the condition whereby it will be attracted back into the magnetic brush unit. More specifically, because the residual toner is so highly negatively charged, it will be attracted toward the magnetic brush unit 22 which is less negatively charged than the charged photoconductive surface 13. It was thought that this residual toner could create a problem at the imaging station 20 location by blocking the light from the photoreceptor. However, since the residual toner also partially blocks the affect of charging station 18, i.e., areas with residual toner will not charge to the same negative level as those areas free of residual toner. This system is self-compensating in that the resulting photoreceptive surface 13 voltage is approximately the same whether it has residual toner thereon in an imaged area or not.

It will be appreciated that the potential levels in FIG. 2 are depicted more for clarity rather than absolute level.

In the preferred embodiment, the self-cleaning apparatus 10 was described as having a cleaning corona 28 and a cleaning lamp 30. It has been found empirically that these two stations 28, 30 are not essential in the operation of the self-cleaning apparatus 10 when the charging station 18 is a scorotron. Experiments were conducted in which first the cleaning lamp 30 was turned off during a printing cycle with the cleaning corona 28 enabled, then the reverse with the cleaning corona off and the cleaning lamp on and finally both were turned off during a printing cycle. It was found with both stations 28, 30 turned off the apparatus 10 still performed in a sataisfactory method by exhibiting a high degree of self-cleaning. With one or the other stations turned on, the operation seemed to improve but there appeared to be little or no difference whether one or the other were turned off. Obviously, with both the cleaning corona 28 and cleaning lamp 38 both on, the operation was better and as a consequence in the preferred embodiment of the invention the contribution of two stations should be included. A disadvantage was found when the cleaning lamp 30 was off and charge station 28 remained active. It was found that iron pull-out occurred on the seam of the belt 13. Since no images are created at the seam, this does not present an immediate problem.

With regard to not using the cleaning lamp, another disadvantage may present itself when an organic photoconductor is used because it may charge to a point where voltage breakdown or pin holing occurs. This is not a problem for other types of photoconductors, such as zinc oxide, because of their ability to leak charges. It is also important to note that after a print cycle is completed, the machine will remove the residual toner during the next cycle while it is being charged. If the toner is not removed and remains on the photoconductive surface for a long period, i.e. hours or days, it will gradually leak its charge and may effect the next print cycle. Consequently, after the last run of the day, it may be advantageous to run a blank cycle.

I claim:

1. In a xerographic reproducing apparatus wherein a belt having a photoconductive surface is rotated so as to address a series of xerographic processing stations and the surface is cleaned of residual toner without the need of a cleaning station or a second cycle, the combination comprising:

an endless photoconductive belt, means for conveying said belt about a path, a charge station operative to place a charge of a given polarity on said photoconductive belt, an imaging means for creating an image on said surface by discharging selected areas thereof, a development station operative to place toner particles into contact with said belt means for applying to said development station a bias with the same polarity as said charge station is operative to place on said photoconductive belt but at a lower level, a feed station downstream from said development station for placing a sheet into contact with said belt, a transfer station addressing said photoconductive belt downstream from said feed station and being operative to create an electric field of a polarity opposite to the said bias, a corotron having the same polarity as said charge station downstream from the transfer station and a lamp addressing said belt downstream from said corotron.

2. The apparatus of claim 1 wherein said development station is a magnetic brush unit.

3. The apparatus of claim 2 wherein said given charge placed on said photoconductive belt is negative and magnetic brush unit is negatively biased.

4. In a xerographic apparatus wherein a photoelectric surface is rotated so as to address a series of xerographic processing stations, the combination comprising:

an endless belt having an outer photoconductive surface, means for conveying said belt about a path, first charge means located on said path for placing a charge of a given polarity on said photoconductive surface, imaging means located on said path downstream from said first charge means for creating an image with a charged background thereabout on said photoconductive surface by discharging selected areas thereof, development means located on said path downstream from said imaging means for placing toner particles on said photoconductive surface, means for applying a bias of the same polarity as said given polarity but of a lower level to said development means, sheet feed means located on said path downstream from said development station for contacting a sheet with said photoconductive surface, second charge means located on said path downstream from said feed means, said second charge means being capable of creating an electric field of a polarity opposite to said background and said bias, and separating means located downstream from said second charge means for removing a sheet from said photoconductive surface.

5. The apparatus of claim 4 including a third charge means having a charge of said first given polarity on said path downstream from said separating station.

6. The apparatus of claim 4 including light emitting means located on said path downstream from said separating station.

7. The apparatus of claim 5 including light emitting means located on said path downstream from said third charge means.

8. The apparatus of claim 4 wherein said first charge means is a scorotron.

9. In a method of reproducing a document wherein a belt having a photoconductive surface is rotated so as to address a series of xerographic processing stations and the photoconductive surface is cleaned without the need of a cleaning station or a second cycle, the steps comprising:

creating a charge on a photoconductive surface of a first polarity, creating an image on said charged photoconductive surface by discharging selected areas thereof, developing the image by placing toner particles having a charge of the first polarity but of a lower level on the photoconducting belt, placing a sheet into contact with the developed image, transferring the toner of the developed image from the photoconductive belt to the sheet by exposing the photoconductive belt to an electric field of a polarity opposite to the charged particles, creating another charge on the photoconductive surface of said first polarity and exposing the thusly charged photoconductive surface to light.

10. In a method of reproducing a document wherein a photoelectric surface is rotated so as to address a series of xerographic processing stations, the steps comprising:

exposing a photoconductive surface to a charge station for placing a charge of a first polarity on the photoconductive surface, creating an image on the thusly charged photoconductive surface by discharging selected areas thereof, developing the image by exposing the photoconductive surface to toner particles charged with the first polarity but of a lower level then the charge on the photoconductive surface, placing a sheet into contact with the developed image and transferring the toner on the developed image from the photoconductor to the sheet removing the sheet from the photoconductive surface.

11. The method of claim 10 wherein said photoconductive surface is exposed to a cleaning lamp after a sheet is removed from the photoconductive surface.

12. The method of claim 10 wherein said photoconductive surface is exposed to a second charge station after a sheet is removed from the photoconductive surface.

* * * * *